US005303529A

United States Patent [19]

Guardia

[11] Patent Number: 5,303,529

[45] Date of Patent: Apr. 19, 1994

[54] ATTACHMENT OF OBJECTS ON AN INSULATION LAYER OF LOW MECHANICAL STRENGTH

[75] Inventor: Raffaele Guardia, Winterthur, Switzerland

[73] Assignee: Sap Baustoffe und Bauchemie AG, Freidorf, Switzerland

[21] Appl. No.: 543,723

[22] PCT Filed: Nov. 14, 1989

[86] PCT No.: PCT/CH89/00200

§ 371 Date: Jul. 16, 1990

§ 102(e) Date: Jul. 16, 1990

[87] PCT Pub. No.: WO90/05817

PCT Pub. Date: May 31, 1990

[30] Foreign Application Priority Data

Nov. 17, 1988 [CH] Switzerland ..... 4268/88

[51] Int. Cl.[5] ..... E04B 1/00

[52] U.S. Cl. ..... 52/745.15; 52/309.7; 52/309.16

[58] Field of Search ..... 52/202, 309.7, 309.2, 52/480, 309.16, 745.15; 220/444, 445, 446

[56] References Cited

U.S. PATENT DOCUMENTS

| | | | |
|---|---|---|---|
| 2,980,972 | 4/1961 | Kloote et al. | 52/309.9 |
| 3,079,026 | 2/1963 | Posker | 220/436 |
| 3,091,817 | 6/1963 | Dosker | 52/267 |
| 3,158,962 | 12/1964 | Faase | 52/202 |
| 3,401,494 | 9/1968 | Anderson | 52/309.2 |
| 3,518,800 | 7/1970 | Tank | 52/710 |
| 3,642,559 | 2/1972 | Stokes | 52/309 |
| 4,107,833 | 8/1978 | Knight et al. | 220/444 |
| 4,190,305 | 2/1980 | Knight et al. | 220/444 |
| 4,485,295 | 11/1984 | Kellermeyer | 156/251 |
| 4,889,459 | 2/1990 | Jones | 52/36 |
| 4,961,298 | 10/1990 | Nogradi | 52/309.7 |

*Primary Examiner*—Richard E. Chilcot, Jr.
*Assistant Examiner*—Joanne C. Downs
*Attorney, Agent, or Firm*—Bachman & LaPointe

[57] ABSTRACT

Methoding for attaching mechanical devices on an insulation layer by forming a recess in an insulation layer, inserting at least one panel in the recess dimensioned to correspond to the recess and bonding the panel in the recess over the whole extent of the recess, and anchoring a device in the panel.

13 Claims, 6 Drawing Sheets

ATTACHMENT OF OBJECTS ON AN INSULATION LAYER OF LOW MECHANICAL STRENGTH

The invention relates to a method for attaching mechanical devices for guiding, hanging, holding or supporting objects on an insulation layer lining masonry and of low mechanical strength, in particular running rails for slatted roller blinds or slatted shutters in window and door openings insulated on the outside and a machine to carry out the method with an insulation layer made of a foamed plastic.

In many cases, buildings which were erected up to the beginning of the 1970's no longer meet present heat insulation regulations and/or the change in attitude towards environmental protection and conservation of energy resources despite otherwise being of good building material. Reconstruction takes place primarily by applying an outside insulation which provides a better heat balance than a subsequently fitted inside insulation which is, in principle, likewise possible.

Subsequently fitted insulation layers applied to new buildings almost always consist of heat insulating blocks with standardized dimensions which can be cut, if required, on the site using simple devices. After assembly, exposed blocks are usually covered with plaster.

It is known to produce heat insulating blocks of rigid, foamed plastic, for example on the basis of polyurethane or phenolic resol resins. These predominantly closed-cell foams have a high insulation capacity, but they are sensitive to pressure due to their low mechanical strength. No objects can be attached to the insulation layer using customary devices, such as for example plugs.

On a customary outside or inside insulation layer, it is therefore not possible to mount running rails for slatted roller blinds or slatted shutters, suspension brackets and resetting means for slatted blinds or window shutters, consoles to provide a shelving surface, light fittings or hooks for heavy pictures etc.

According to the known prior art, mechanical devices for guiding, handing, holding or supporting objects are therefore attached, according to a first variant, in the masonry located behind the insulation layer. This requites, on the one hand, increased and more complicated work and, on the other hand, longer mechanical devices with a larger cross-section, for example screws. This, in turn, requires larger holes to be drilled and larger plugs to be inserted.

According to a second variant, at the place expected for the attachment of mechanical devices for guiding, hanging, holding or supporting objects, insulation blocks are used which are fitted on the outside with a panel of increased mechanical strength. This requires special blocks to be used according to an exact plan because their position can subsequently no longer be altered. In particular in the region of window and door openings, precise and careful cutting work must be carried out. Furthermore, this variant requires workers of higher qualifications to be employed which thus further increases the costs.

SUMMARY OF THE INVENTION

The inventor has set himself the object of providing a method of the type discussed above which allows a simple and cost-saving manner of work which is also suitable for unskilled workers and does not have to be planned in detail in advance. Furthermore, a machine to carry out the method for an insulation layer made of foamed plastic is to be used.

In relation to the method, the object is achieved according to the invention is that

- a recess of flat extension is made in the insulation layer applied to the masonry, at least one-third of the insulation layer remaining between the recess and the masonry,
- at least one panel dimensioned to correspond to the recess is inserted and bonded in over the whole surface on the base of the recess, at least the outer most panel being of high mechanical strength, and
- the devices are anchored in the bonded-in panel(s) of high mechanical strength.

According to the invention, the insulation layer, in particular an outside insulation, can also be applied in the region of window and door openings without special precautions needing to be taken for the attachment of objects, in particular running rails for slatted roller blinds or slatted shutters, suspension brackets for slatted blinds or window shutters, etc. The recesses can be made with little effort in situ in the finished insulation layer corresponding to the dimensions of the panels of high mechanical strength provided. The bonded-in panels are attached solely to the insulation layer. The flat connection of the insulation layer to the panel of high mechanical strength has a surprisingly great load bearing capacity. Apart from the material, the flat extension and the thickness of the panel with high mechanical strength, said load bearing capacity can be further increased by the fact that two panels of this type, separated by material of low mechanical strength, are bonded in. The advantages in comparison with the method described initially are obvious.

For the insulation layers, the known foamed plastic blocks are preferably used which, for example, are based on polyurethane or phenolic resol resins. On building sites, all foamed plastic blocks are simply called "Sagex panels".

A machine having a metallic resistance wire projecting at right angles is suitable for making recesses of any desired dimensions in an insulation layer made of foamed plastic in a simple manner.

Expediently a recess is made at such a depth that the panel of high mechanical strength can be bonded in flush with the surfaces on the outside after an adhesive, preferably consisting of two components, has been applied. This is also advantageous in particular for a plaster system applied subsequently.

For attaching guide rails for slatted roller blinds or slatted shutters in window or door opening, a significant area of application of the invention, a continuous vertical recess is made in the outside insulation layer, a panel of increased mechanical strength extending likewise essentially over the entire height of the window or of the door is bonded in and the guide rail is attached with screws. In this case, the demands on the mechanical strength are relatively low.

For attaching suspension brackets and resetting means for slatted blinds or window shutters, a trough-shaped, rectangular or square recess is expediently made in each case and a corresponding panel is bonded in. The suspension brackets with a swivel pin must have a higher load bearing capacity than the resetting means.

If a correspondingly deeper recess is to be made, a prefabricated composite panel can be bonded in which, on both sides, has covering panels of high strength for attaching devices with a higher transmission of force.

Instead of prefabricated composite panels, the individual panels can also be bonded into the recess in situ, that is to say firstly a panel with high mechanical strength, then a panel made of insulation material and finally another panel with high mechanical strength which is preferably flush with the surfaces of the insulation layer.

The panel of high mechanical strength bonded into a recess of an insulation layer must be unbreakable. In the case of outside insulation, a good resistance to moisture is an advantageous property. Since high temperature fluctuations occur in particular in the case of outside insulations, temperature-related changes in length occur in the bonded materials. It is therefore advantageous to bond in a panel of high mechanical strength which has a thermal expansion coefficient which is as close as possible to that of the insulation layer. This is of essential significance, above all in the case of long bonded-in panels, such as for example for attaching running rails for slatted roller blinds or slatted shutters.

For a panel of high mechanical strength bonded into the recess, the following materials are suitable, economy also being taken into account in particular in the selection, in addition to the parameters of mechanical strength, resistance to breakage and moisture, and the thermal expansion coefficient:

plastics, such as polyolefins, polyaromatics, polyesters or polyureas, metals, such as aluminium, aluminium alloys, copper or brass, wood.

Melamine resin laminates which have a thermal expansion coefficient which is very close to that of the common Sagex panels have proved to be particularly suitable. These melamine laminate panels are constructed as hard-core panels, in particular when they are to be used for attaching running rails.

However, an exceptionally high load bearing capacity of the mechanical devices attached according to the invention for guiding, hanging, holding or supporting objects on masonry with an insulation layer of low strength not only requires the panels to be bonded into the recess faultlessly and over the whole surface, but it also requires optimum bonding of the masonry or of the backing plaster with the inside surface of the insulation layer. Appropriate pretreatment and priming known to the person skilled in the art are usually necessary for this purpose.

In respect of the apparatus for making a recess in an insulation layer made of a foamed plastic, the object is achieved according to the invention by the fact that a machine has an electrically heatable resistance wire bent at right angles in the shape of a U which can be adjusted in relation to height and can be used in various lengths.

The wire of the machine heated by electrical resistance is intended to cut out the correct dimensions of the recess in one operation. In the case of a resistance wire of integral construction, said wire can be exchanged with few manipulations so that recesses of different widths can be made in one operation. The height adjustability relevant for the depth of the recess results due to a resistance wire which can be clamped at various distances from the machine or due to exchangeable resistance wires with different lengths for the two parallel limbs.

Instead of a single resistance wire, several, linearly adjacent, U-shaped resistance wires can be used. The width of the recess to be made can thus be adjusted in stages.

The machine preferably has stop surfaces for guiding on the insulation layer and along a gauge with a straight conducting surface.

BRIEF DESCRIPTION OF THE DRAWINGS

The invention is described in greater detail with reference to the exemplary embodiments illustrated diagrammatically in the drawing, in which.

DETAILED DESCRIPTION OF PREFERRED EMBODIMENTS

Figure 1:
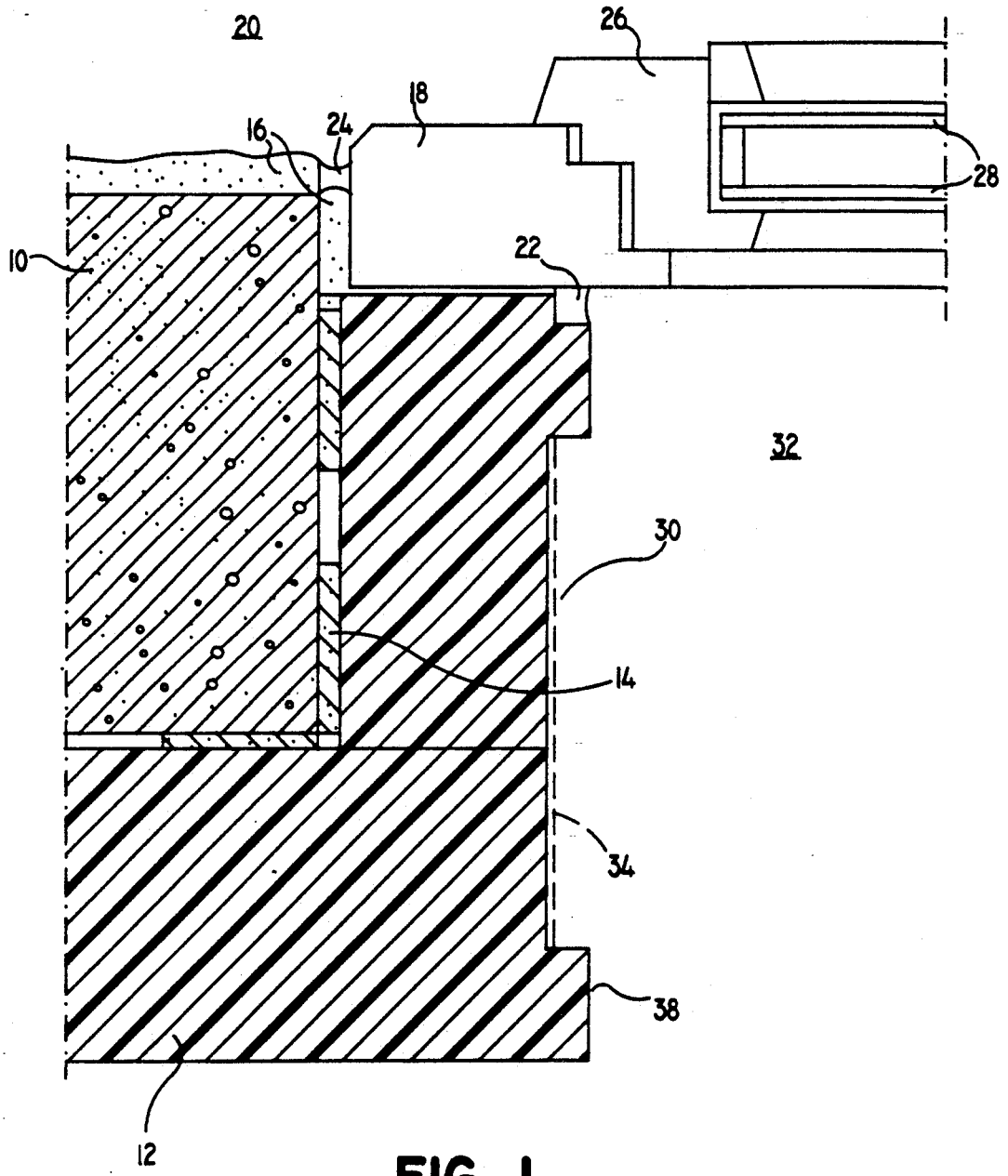
FIG. 1 shows a horizontal partial section through a window opening with a recess provided.

The masonry 10, illustrated in FIGS. 1–5, of a building is fitted with an outside insulation 12 made of foamed plastic blocks. An adhesive mortar 14 is inserted between the masonry 10 and the outside insulation 12. Said adhesive mortar bonds the masonry 10, if appropriate with a backing plaster, and the foamed plastic blocks of the outside insulation 12 with a high adhesive capacity.

The masonry 10 has an inside plaster 16. The window frame 18 made of wood, plastic and/or metal is mounted in such a way that a joint is produced both in relation to the interior 20 of the building and in relation to the outside, which joint is filled with putty 22, 24. The window sash 26 with the double glazing 28 is illustrated in closed position.

In the outside insulation a recess 30 is made which, in the present case, in 6 cam wide and 0.6 cam deep. The outside insulation 12 is 2–18 cm thick, in the present case somewhat thicker on the outside of the masonry 10 than in the window opening 32.

Figure 2:
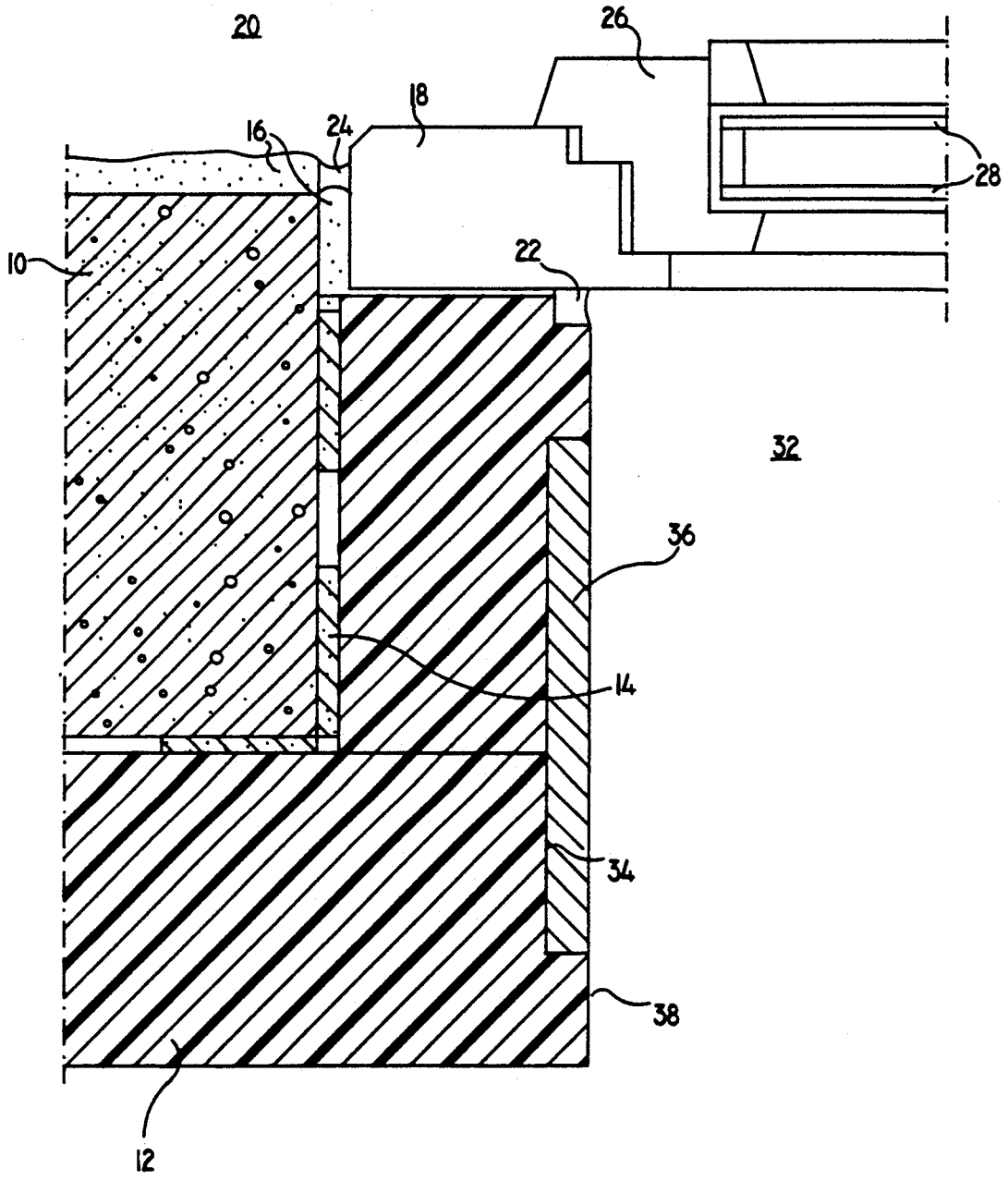
FIG. 2 shows a panel of high mechanical strength bonded into the recess according to FIG. 1.

An adhesive 34, a two-component mixture, is applied in the recess 30 over the whole surface and the panel 36 with high mechanical strength is pressed on. The thickness of the panel 36 and the depth of the recess 30 match, the surface 38 of the outside insulation 12 and that of the panel 36 are flush (FIG. 2). When the panel 36 is pressed on, the lateral gap between the panel 36 and the outside insulation 12 can also be filled, at least partially, with adhesive.

Figure 3:
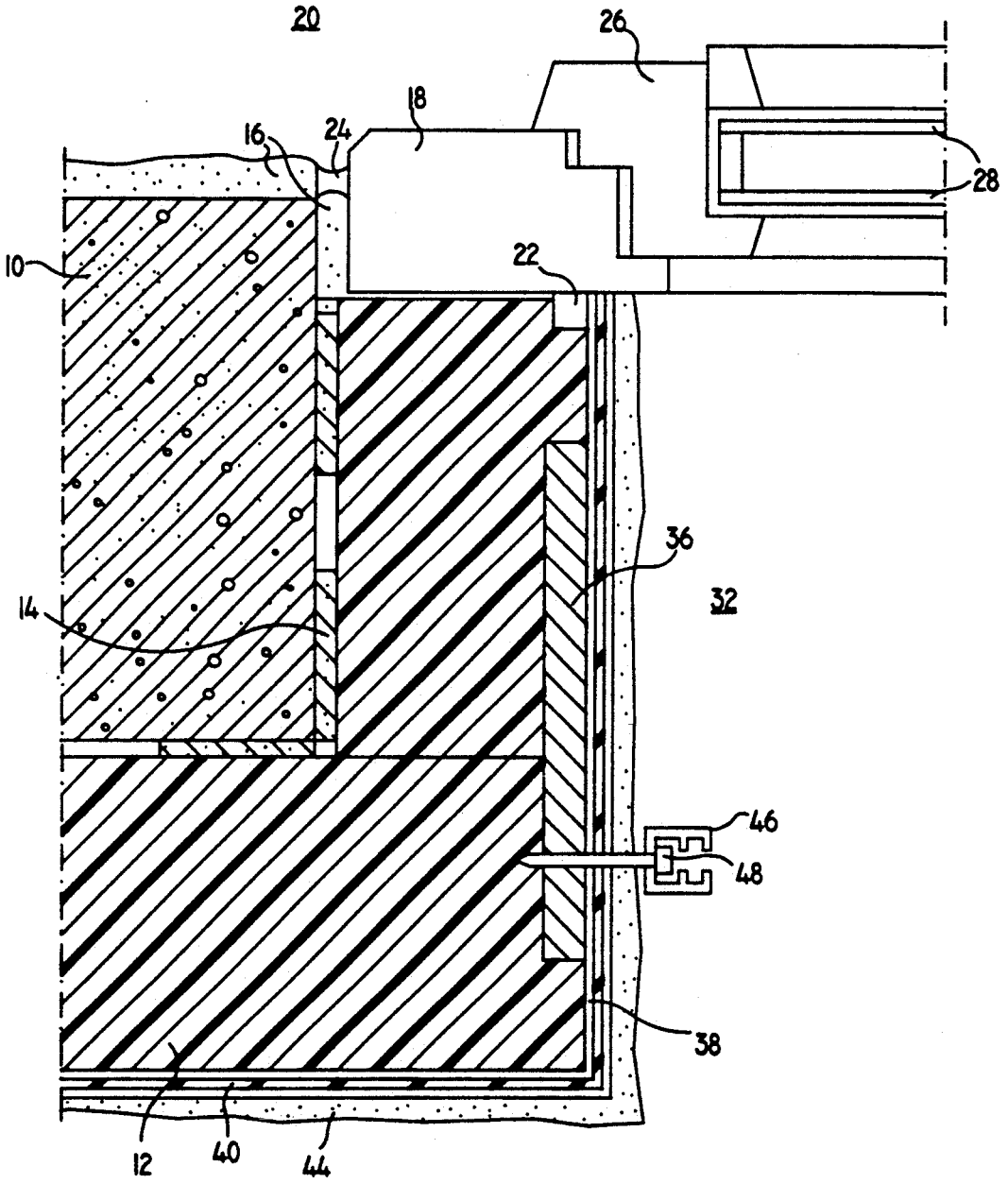
FIG. 3 shows a running rail for a slatted roller blind anchored in the panel according to FIG. 2.

According to FIG. 3, the surface 38 of the outside insulation 12 and the panel 36 are covered with a plaster system. The latter consists of a reinforcement 40, for example a glass fiber fabric which extends beyond the putty 22 to the window frame 18. The reinforcement 40 is covered by a floodcoat and a premixed plaster 44 which extend in the window opening 32 to the window frame 18.

A running rail 46 for a slatted roller blind (not illustrated) is anchored in the panel 36 by means of screws 48 penetrating the plaster system. Forces acting on the running rail 46 are transmitted to the panel 36 and are effective over the whole bonding surface of the panel 36 with the outside insulation 12. The forces transmitted onto a large area of the outside insulation 12 with low strength are reduced in such a way that said insulation can withstand them.

If only small forces are expected to act on the running rail 46, the panel 36 can be considerably reduced in size, for example it can be only half as wide.

The running rail 46 is attached in the panel 36 with high mechanical strength by means of several screws 48 which are only indicated. Depending on the thickness of the panel 36, its material and the force exerted, the screws 48 are inserted in the panel 36 or penetrate the latter.

The windowsill 50 (FIG. 4) is drawn in the lower region of the window opening 32.

Arranged in the upper region of the window opening 32, immediately below the lintel 54, is an insulated slatted roller blind box 52.

Figure 4:
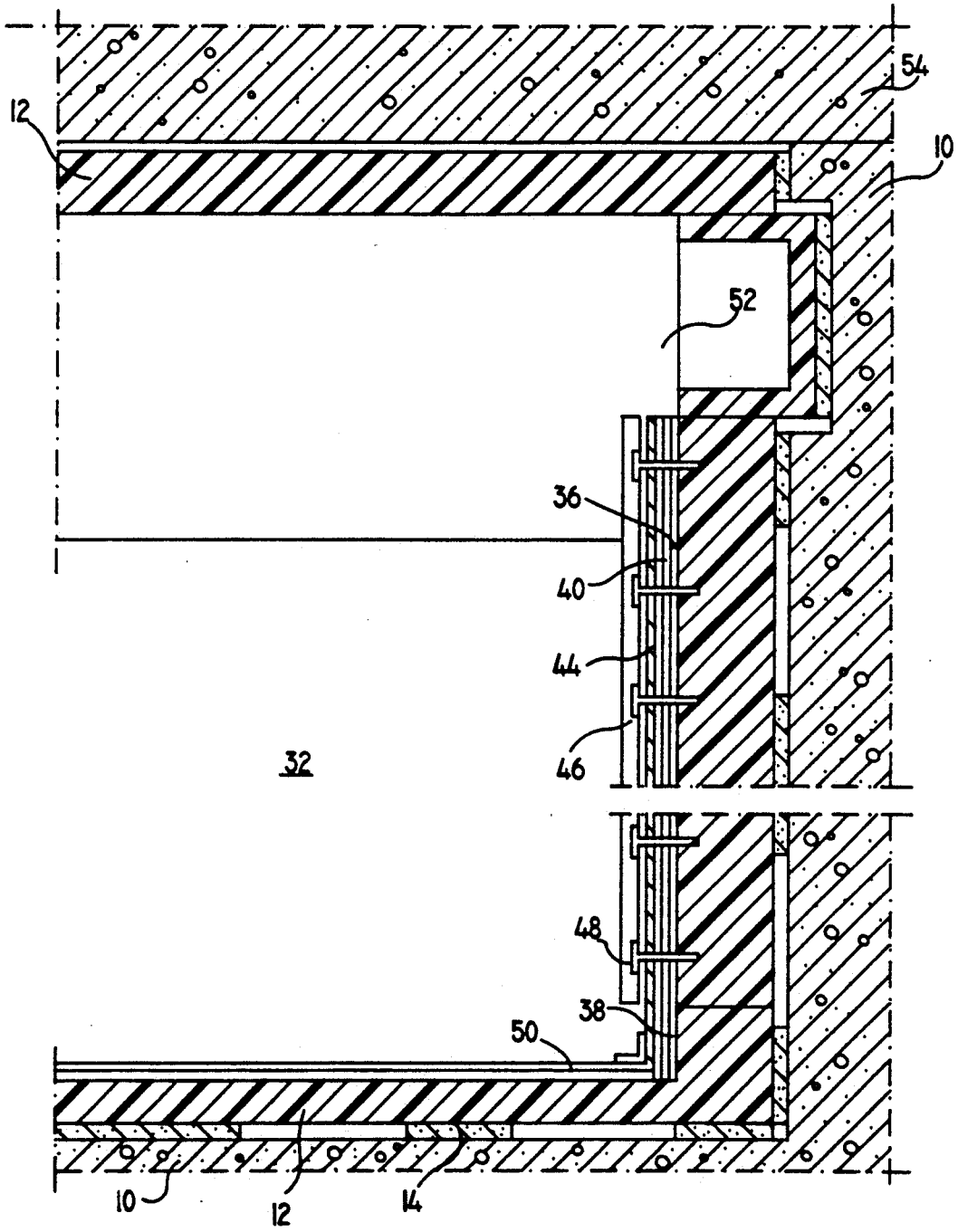
FIG. 4 shows a vertical partial section through a window opening according to FIGS. 1–3.
Figure 5:
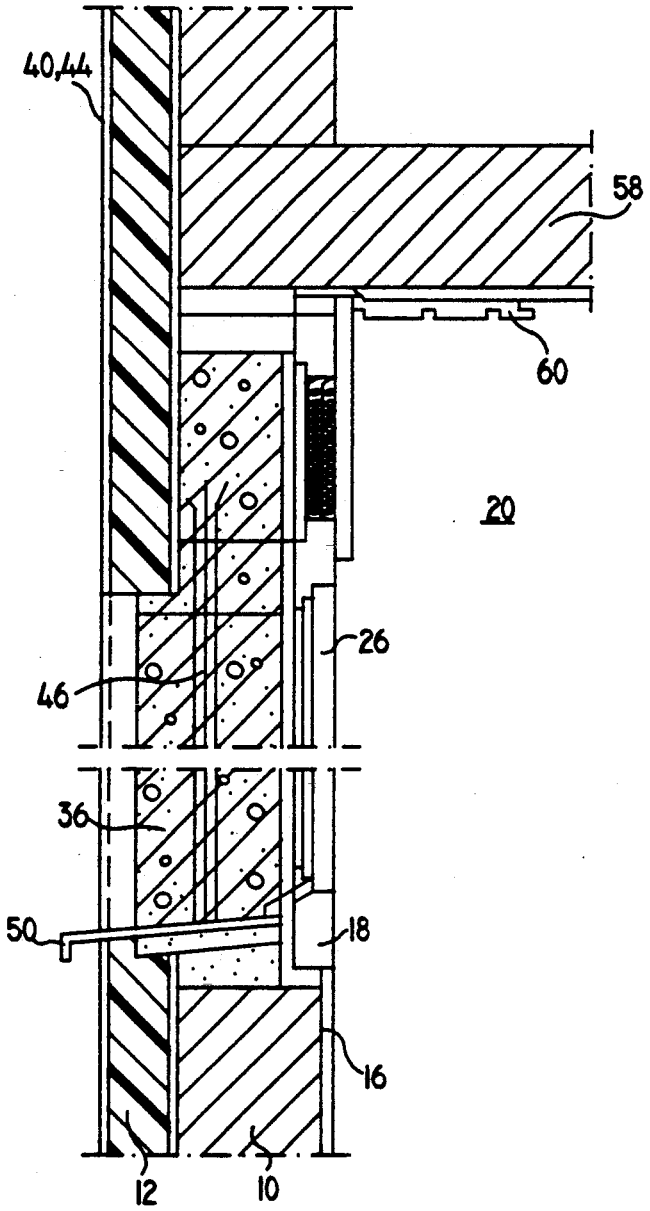
FIG. 5 shows a cut-open lateral view of a window opening.

It can be seen in FIGS. 4 and 5 that the panel 36 extends in the vertical direction essentially over the entire height of the window opening 32. The window opening 32 is bounded at the bottom by a windowsill 50, leading up to which is the running rail 46 for the slatted roller blind. The likewise visible ceiling 58 is lined with panelling 60.

Figure 6:
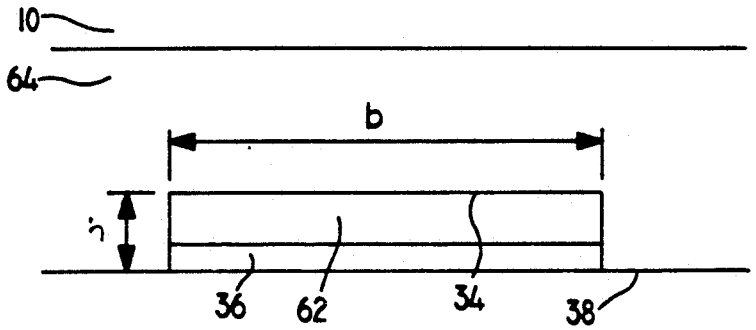
FIG. 6 shows a composite panel with one layer of high and one of low strength inserted into a recess.
Figure 7:
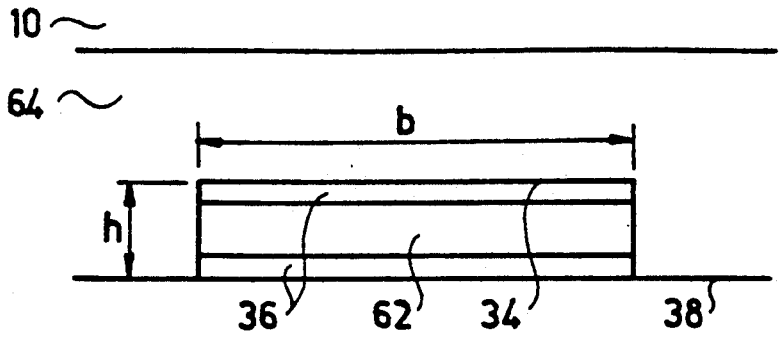
FIG. 7 shows a composite plate with covering layers of high strength, e.g. for a shutter suspension bracket, inserted into a recess.
Figure 8:
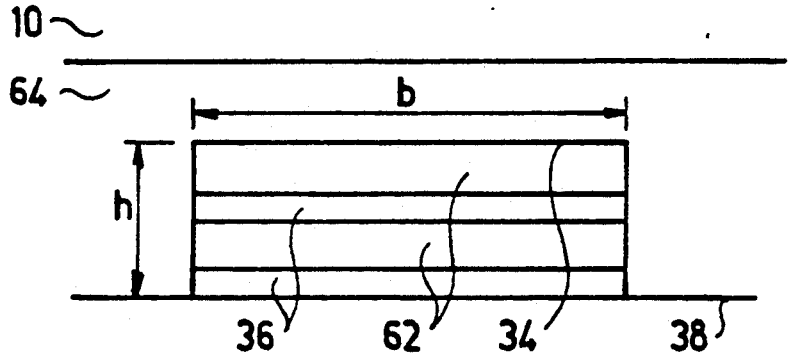
FIG. 8 shows a variant of the principle according to FIG. 7.

FIGS. 6 to 8 show an insulation layer 64 made of foamed plastic, which insulation layer is mounted on the outside or inside of building masonry 10. Bonded into a recess by means of a two-component adhesive 34 is a composite panel 36, 62 which comprises, for example, a panel 36 with high mechanical strength, flush with the surface 38 of the insulation layer 64, and a panel 62 with low mechanical strength, for example made of the same material as the insulation layer 64 (FIG. 6), two covering panels 36 and a core panel 62 made of foam (FIG. 7), or two panels 36 and two panels 62 (FIG. 8).

In the case of the panels 36 with high mechanical strength being arranged separately (FIGS. 7, 8), a screw, for example, penetrates the first panel and is anchored in the second panel with or without penetration.

To achieve the flush alignment of the surfaces of the panel 36 with the surface 38 of the insulation layer 64, the depth h of the recess 30 (FIG. 1) corresponds in each case to the thickness of the inserted composite panel 36, 62 of width b.

Figure 9:
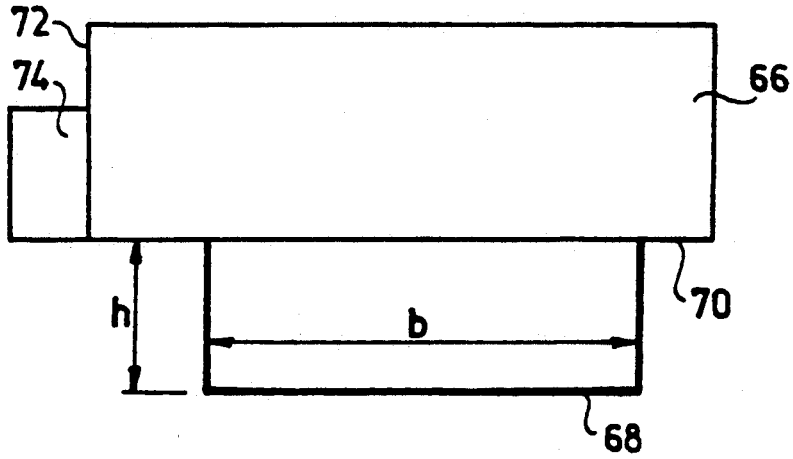
FIG. 9 shows a principle sketch of a machine for making recesses.

The machine 66 shown in FIG. 9 to make a recess in an insulation layer 12, 64 comprises an exchangeable resistance wire 68 bent at right angles in the shape of a U, which is electrically heatable. This wire can be clamped in an electrically conducting manner at any desired distance h from the stop surface 70 of the machine 66 which, in working position, rests on the insulation layer 12, 64. The distance b of the parallel limbs of the resistance wire 68 determines the width b of the recess 30 (FIG. 1).

When making the recess in the insulation layer 12, 64, the machine 66 is moved with its stop surface 72 along a gauge 74 with a straight conducting surface in the vertical direction in relation to the drawing sheet.

I claim:

1. Method for attaching mechanical devices for guiding, handing, holding or supporting objects on a building insulation layer lining masonry, which comprises:

providing an insulation layer lining masonry, wherein the insulation layer is provided on the outside of a building;

forming an elongated recess in the insulation layer in the region of at least one of a window and door opening, wherein at least one-third of the insulation layer remains between the recess and the masonry;

inserting at least one panel in the recess dimensioned to correspond to the recess, and bonding said panel into the recess over the whole extent of the recess, wherein at least the outermost of said panel is of high mechanical strength; and anchoring at least one mechanical device in the bonded in panel.

2. Method according to claim 1 wherein the recess if formed in the insulation layer be means of a machine having a metallic resistance wire projecting therefrom at right angles.

3. Method according to claim 1 wherein said insulation is of a foamed plastic.

4. Method according to claim 3 wherein said insulation is based on a material selected from the group consisting of polyurethane and phenolic resins.

5. Method according to claim 1 wherein the recess is formed at such a depth and width that said at least one panel is flush with a surface of the insulation layer.

6. Method according to claim 1 wherein a continuous recess is formed in the insulation layer and a corresponding panel is bonded into said recess, and guide rails for slatted roller blinds or slatted shutter are attached to said panel with screws.

7. Method according to claim 1 wherein a trough-shaped recess is formed in the insulation layer and a corresponding composite panel is bonded into said recess for attaching suspension brackets and resetting means for slatted blinds or window shutters.

8. Method according to claim 1 wherein a prefabricated, composite panel wit two sides in bonded into the recess, wherein said panel has covering panels on both sides thereof of high strength for attaching thereto devices producing relatively high forces.

9. Method according to claim 1 wherein individual components of a composite panel are bonded into the recess, one after another in situ.

10. Method according to claim 1 including the step of inserting a plastic panel of high mechanical strength in the recess.

11. Method according to claim 1 including the step of inserting a melamine resin laminate panel of high mechanical strength is the recess.

12. Method according to claim 1 including the step of inserting a non-rusting metal panel of high mechanical strength in the recess.

13. Method according to claim 1 including the step of inserting a wood panel of high mechanical strength in the recess.

* * * * *